United States Patent [19]

Kawanami et al.

[11] 4,412,442

[45] Nov. 1, 1983

[54] METHOD FOR BENDING A METAL PIPE

[75] Inventors: Shumpei Kawanami, Hiratsuka; Yasuo Watanabe, Kitakyushu; Susumu Hanyo, Yokusuka, all of Japan

[73] Assignee: Dai-Ichi High Frequency Co., Ltd., Tokyo, Japan

[21] Appl. No.: 188,052

[22] Filed: Sep. 17, 1980

[30] Foreign Application Priority Data

Sep. 21, 1979 [JP] Japan ..... 54/120833

[51] Int. Cl.[3] ..... B21D 7/16

[52] U.S. Cl. ..... 72/128; 72/342; 72/369

[58] Field of Search ..... 72/13, 128, 342, 364, 72/369; 219/8.5, 10.43, 153, 154

[56] References Cited

U.S. PATENT DOCUMENTS

| | | | |
|---|---|---|---|
| 2,286,893 | 6/1942 | Boissou | 72/342 |
| 3,724,258 | 4/1973 | Hofstede et al. | 72/342 |
| 3,958,438 | 5/1976 | Somov et al. | 72/128 |
| 4,056,960 | 11/1977 | Kawanami | 72/128 |
| 4,061,005 | 12/1977 | Kawanami et al. | 72/128 X |
| 4,062,216 | 12/1977 | Hanamoto et al. | 72/128 |
| 4,122,697 | 10/1978 | Hanyo et al. | 72/128 |
| 4,151,732 | 5/1979 | Hofstede et al. | 72/128 X |
| 4,195,506 | 4/1980 | Kawanami et al. | 72/128 X |

FOREIGN PATENT DOCUMENTS

| | | | |
|---|---|---|---|
| 580030 | 11/1977 | U.S.S.R. | 72/128 |

*Primary Examiner*—Lowell A. Larson
*Attorney, Agent, or Firm*—L. Lawton Rogers, III

[57] ABSTRACT

A method and hot bending apparatus for metal pipes in which the temperature of the pipe is kept constant during "gradation bending". The temperature may be adjusted by adjusting the power applied to the heater, or alternatively by adjusting the relative movement of the pipe with respect to the heater. While a feedback system may be utilized, a predetermined program is preferred under control of a microprocessor.

8 Claims, 5 Drawing Figures

METHOD FOR BENDING A METAL PIPE

BACKGROUND OF THE INVENTION

This invention relates to a method and apparatus for hot bending a metal pipe, and especially to a method of keeping the heating temperature substantially constant while gradation bending, in which the bending radius is changed gradually at the start and the end of the bending process to produce smooth bends while avoiding abrupt changes in pipe wall thickness.

The prior art includes a method for hot bending a metal pipe, wherein the pipe is heated locally with a circular heater such as induction heater or the like, and where the heated zone is moved relatively to the pipe by means of moving the pipe and/or the heater while bending moment is applied to said heated zone to cause bending, and after which the pipe is cooled in the vicinity of the bend.

But is it not well known how to prevent abrupt changes in pipe wall thickness due to abrupt change of radius of curvature at the start and the end of the bending process when the relative bending radius (i.e., the ratio of bending radius to pipe diameter R/D) is very small. However, it is very important to prevent such abrupt changes in pipe wall thickness because of problems that make the bending itself very difficult, e.g., swelling or wrinkling at the start of the bending process, and severe concentration of bending stress.

In relation to the method to make said change of pipe wall thickness gentle and smooth, a Japanese Patent Application No. 51-150809 has been laid open in which the bending radius is changed gradually at the start and the end of the bending process and in which the mean radius of bending is made equal to the desired radius. This process is call "gradation bending".

Gradation bending is based on basic principle of hot bending and covers many cases wherein a pipe to be bent is heated locally with a circular heater such as induction heater or the like and the heated zone is moved relatively to the longitudinal direction of the pipe by means of moving the pipe to be bent and/or the heater while a bending moment is applied to the heated zone to cause bending. After bending, the pipe is cooled in the vicinity of the bend. Further, bending may be started at a larger radius than the desired radius and reduced gradually until it becomes slightly smaller than the specified radius within a certain predetermined small range of bending angle.

In a case in which heating temperature changes significantly as a function of the relative speed of the heated zone to the pipe to be bend. Such change can happen in the case of typical prior art induction bender shown in FIG. 1 where the pipe 1 is fed at a constant speed and heater H is displaced gradually for "gradation bending".

In FIG. 1, 1 is a pipe to be bent, 2 is a bent portion of the pipe, 3 is the center of heated zone where deformation of bending arises, H is a heating means (such as induction heater) equipped with cooling means in one body, 4 is a bending arm which clamps pipe 1 at the top of it and can rotate freely around a center 0, 5 and 6 are guide rollers to guide and support the pipe 1 against the bending forces, P is the thrust to feed pipe 1 and exert bending moment at the heated zone 3, W is the speed of pipe 1 to the right, h is the speed of heater H to the left, and A is a point which is an intersection of the axis of pipe 1 and a plane which is vertical to pipe 1 and includes the point 0.

In normal bending, heater H is located at point A or in the vicinity of it and then radius of bending is kept substantially equal to the effective length Ro of bending arm 4.

In the case of gradation bending, heater H is first located at point 3 of FIG. 1 spaced from A by certain proper distance towards bending arm 4 and is displaced gradually to point A in order to change the radius of bending from large to small gradually.

With reference to FIG. 1, the change of bending radius R is accomplished as follows:

Within a minute interval of time $\Delta t$, the pipe 1 is fed to the right by a minute length $dS_1$ at a constant speed W, while heater H is moved to the left by a minute length $dS_2$ and the pipe is bent by a minute angle $d\theta$ where the length of pipe before and after bending is assumed unchanged.

$$R = \frac{dS_1 + dS_2}{d\theta} = \frac{dS}{d\theta} \tag{1}$$

where $dS = dS_1 + dS_2$

If heater H is not moved and fixed, then:

$$R = dS_1/d\theta = Ro \tag{2}$$

Formula (2) means that radius of bending R is substantially equal to the effective length of bending arm Ro when the position of the heater is fixed.

From formulas (1) and (2) above:

$$\frac{R}{Ro} = \frac{dS_1 + dS_2}{dS_1} = \frac{(dS_1/dt + dS_2/dt)}{dS_1/dt} \tag{3}$$

Since as $dS_1/dt = W$, and $dS_2/dt = h$:

$$\frac{R}{Ro} = \frac{W + h}{W} \tag{4}$$

The relative speed V of the heated zone to the pipe is:

$$V = W + h \tag{5}$$

If for instance, bending is started at a radius R twice as larger as Ro, then from formula (4), $$\frac{R}{Ro} = 2 = \frac{W + h}{W} \text{ or } h = W \tag{6}$$

When heater H is moved at a high speed, heating temperature becomes very low if heating power is kept constant. If doubled effective heating power would be supplied, then the heating temperature should be kept substantially constant.

It is normal to control heating temperature by means of controlling heating power corresponding to a deviation of heating temperature measured with an instrument, but such feedback method is not effective when the change of h (or V) is very large.

The present invention is directed to a program for keeping heating temperature substantially constant by controlling the heating power supply or alternatively keeping the relative speed V constant from the start to the end of bending by means of controlling W and h separately.

THE DRAWINGS

DESCRIPTION OF THE PREFERRED EMBODIMENT

This invention relates to use of above two methods of keeping heating temperature constant while gradation bending is performed. A very large heating capacity is required in order to cover large changes in heating power in case-1, so that case-2 where heating power is kept constant is much more preferable. But case-b 1 may be useful when the capacity of the heating power is large enough because of the simpleness of the control mechanism that is only changing effective power supply corresponding to the change of relative speed of heated zone to the pipe to be bent.

In case-1, the change of radius of bending is achieved as follows:

For example, let Rs be the specified or desired radius of bending, D be pipe diameter to be bent and let Rs/d=1.5. At the start of bending, the speed h of the heater H to the left (FIG. 1) is taken equal to the speed W of the pipe to the right (constant during bending) and is thereafter changed to zero gradually within a certain small range of bending angle $\theta$. Thus, changing the speed V from 2W to W, the radius of curvature is changed from 2Ro to Ro gradually.

It is true theoretically that Ro should be a little bit smaller than specified radius Rs in order to make mean radius of the bend equal to Rs, but the difference between Rs and Ro is so small as to be within the normal allowable deflection of a bending machine.

At the end of bending, radius R is again changed gradually from Ro to normally 2Ro in above case by means of changing speed h from zero to W gradually and changing speed V from W to 2W.

In case-2, it is important to make the program to change W and h separately so as to keep V constant and to change radius of bending according to the predetermined program.

Figure 2:
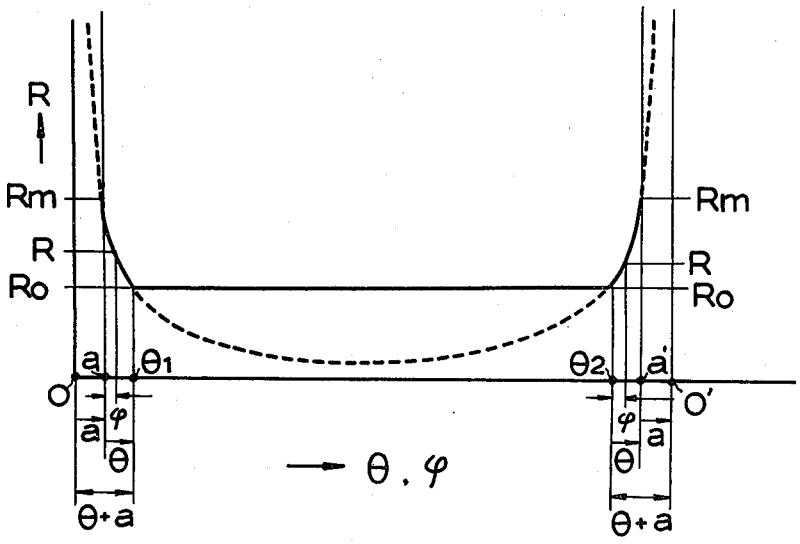
FIG. 2 is a chart showing the change of radius of bending corresponding to changes in the bending angle.

The principle would be explained with a simple example in which radius of bending R is changed hyperbolically corresponding to bending angle $\theta$ as shown in FIG. 2.

Figure 1:
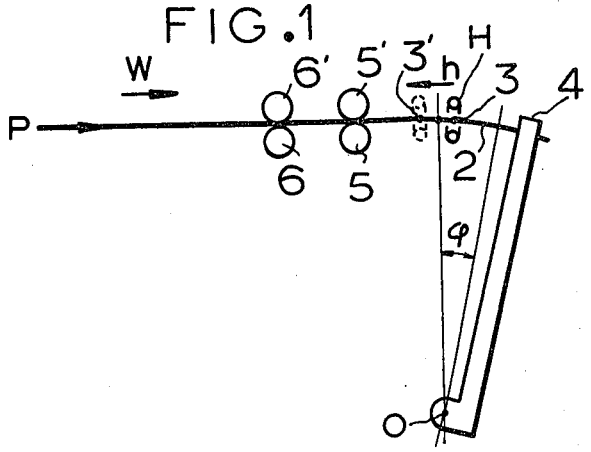
FIG. 1 is a schematic diagram showing construction of a prior art induction heating pipe bender.
Figure 3:
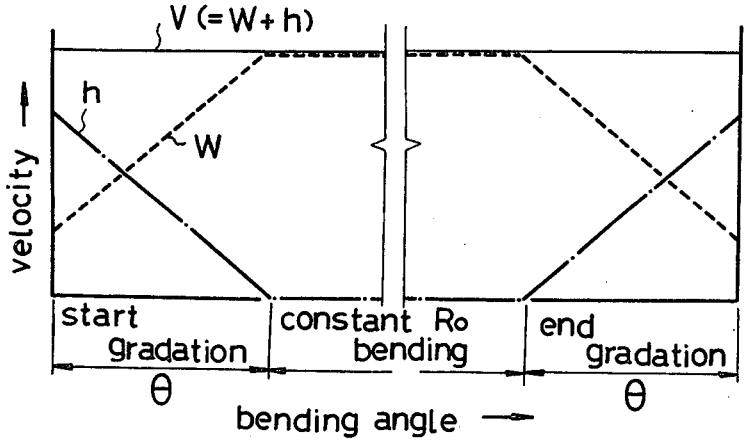
FIG. 3 is a chart showing the change of each speed between the pipe and heater corresponding to changes in the bending angle.

In case-2 and with reference to FIGS. 1–3:

$$V = W + h = \text{constant} \tag{7}$$

From formula (4):

$$R/Ro = V/W$$

Let Rm be the largest radius of bending at the start, Ro be effective length of bending arm, a be start point at the horizontal coordinate, 0 be range of gradation and $\phi$ be an angle within $\theta$, then, $$\frac{R}{Ro} = \frac{\theta + a}{\phi + a}$$

$$\text{and } a = \frac{0}{\alpha - 1}, \text{ where } \alpha = Rm/Ro \tag{10}$$

$$\text{and } W = V\frac{\phi + a}{\theta + a}, \text{ where } h = V\left(1 - \frac{\phi + a}{\theta + a}\right) \tag{11}$$

Value a has been introduced in order to prevent starting with an infinitive radius of bending, and to start bending at a proper radius (for instance 2Ro) so that if a=2, then a=$\theta$.

Bending angle $\phi$ must be counted zero at point a′ in programming W and h in relation to bending angle $\phi$ at the start of bending, and gradation bending is operated from $\phi$=zero to $\phi=\theta$ (normally less than 8 degrees) and finished at point $0_1$.

At the end of bending, it is convenient to take another symmetrical coordinate as shown in FIG. 2 wherein original point of horizontal coordinate is 0′, where bending is finished at the point a′, and $\theta$ is range of gradation (less than 8 degree).

In programming, gradation starts at point $\theta_2$ and programmed angle $\phi$ must be counted from $\theta_2$, being zero at $\theta_2$ and $\theta$ at a′ where bending is completed.

At this stage, the program should be naturally be:

$$h = V\frac{\phi}{\theta + a}, \quad W = V\left(1 - \frac{\phi}{\theta + a}\right) \tag{12}$$

or:

$$h = V\frac{\phi}{\theta}\left(1 - \frac{1}{a}\right), \quad W = V\left[1 - \frac{\phi}{\theta}\left(1 - \frac{1}{a}\right)\right] \tag{13}$$

As the result of gradation bending according to program (11) and (13), speed V which is equal to (W+h) is kept constant and then heating temperature is kept constant only by keeping heating power constant, while W and H is changed as shown in FIG. 3 and therefore the radius of bending is changed as shown in FIG. 2.

It must be noted that gradation range $\theta$ should be not larger than the required minimum value and preferably should be less than 8 degrees, because a large gradation range should be compensated with a small radius of bending between the start and the end gradation in order to achieve a mean radius of bending equal to the specified radius Rs. More preferably, 5 to 6 degrees of gradation range is adopted, because in such small gradation the deviation of bending radius can be made negligibly small. If a very large range of gradation should be adopted, it would cause difficult mechanical problems and would cause impreciseness of the bending radius.

The above program control may be accomplished with a microcomputer, electric instruments using electric motors or hydraulic equipment.

Figure 4:
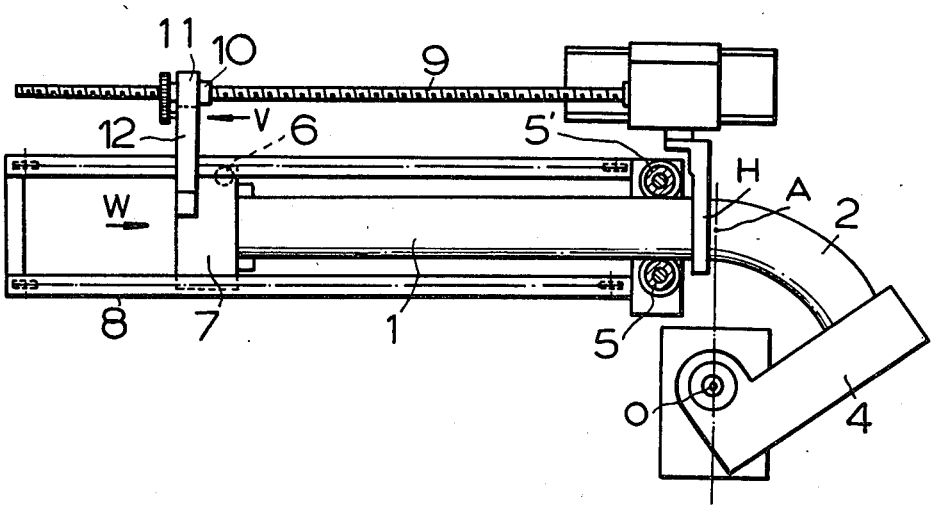
FIG. 4 is a pictorial view in elevation of an example according to this invention.

On the other hand there is a simple mechanical method to keep V constant. With reference to FIG. 4, elements which are common with FIG. 1 are nominated with the same numeral. Further, a thrusting means 7 is used to clamp the tail end of pipe 1 to feed pipe 1 with thrusting force P, a driving means 8 drives thrusting means 7, a screw 9 is installed between the thrusting means 7 and the heater H to give constant relative speed V, a nut 10 is provided to move the screw 9 while supported with a bracket 11 and rotated at a proper constant speed with a geared variable speed motor 12. Bracket 11 is fixed on the thrusting means 7 and the heater H is displaceable on a rail parallel to the pipe 1.

As is clear from FIG. 4, the relative speed V (i.e., the speed of heated zone relative to the pipe 1) is kept constant as long as rotating speed of nut 10 is kept constant, and the value of V is taken equal to normal proper bending speed. To provide gradation at the start of bending, speed W of pipe 1 is changed slowly from small (normally V/2) to large (V). At first, when W is smaller than V, heater H moves to the left and when W becomes equal to V heater H is stopped at point 0. Thereafter, bending is performed at a constant radius Ro for a while and at the end of bending the speed W is made smaller than V gradually until it equals the starting speed (normally V/2) at which point bending is completed.

In FIG. 4, the location of heater H shows the point when bending is completed.

Further in FIG. 4, roller 5' is installed at the opposite side of roller 5 near point 0. Roller 5' is used for controlling excess enlargement of bending radius R caused by misoperation or some other effects, but roller 5' may be omitted if some other control mechanism to regulate R is equipped.

The reason why gradation range $\theta$ is taken smaller than 8 degrees and preferably should be 5 to 6 degrees is to avoid excess deviation of radius R from Ro and to minimize excess reaction force at the pivot 0 and other parts of the bending machine while at the same time performing precise bending. In this case, a method would be adopted in which an auxiliary feedback temperature control system including means to measure heating temperature may be used to get the heating temperature more precisely to a constant, but it is effective only when speed V is very small.

Figure 5:
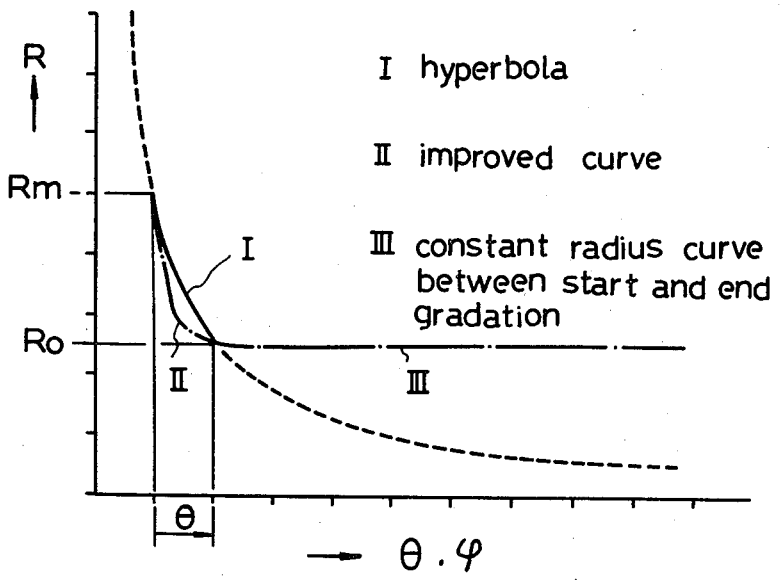
FIG. 5 is a graph showing an improved R−$\phi$ bending program.

Further, FIG. 5 shows another program which is a little bit improved than the case based on the hyperbola illustrated in FIG. 2. At the early stage of gradation, the $R-\phi$ curve may be taken much more steep than the hyperbola and at the end of gradation the curve should be more gentle than the hyperbola. Such improved curve is more natural in regard to connection with constant radius curve III and makes the start of bending easier especially when Rs/D is very small.

According to methods mentioned above, very smooth, small Rs/D bends can be produced and bending temperature is kept adequate and constant, and consequently this invention is useful to supply ideal bends mechanically and metallurgically.

What is claimed is:

1. In the method of hot bending a metal pipe in which the pipe is passed through a heating zone in a heating-/cooling unit while a bending movement is applied and thereafter through a cooling zone in the heating/cooling unit adjacent to the heating zone, and in which the radius of curvature of the bend is larger than the desired radius in the initial and terminal (relatively smaller angle) portions of the bend and greater than the desired radius in the relatively larger angle intermediate portion of the bend, the improvement in which the temperature of the pipe while in the heating zone is maintained a constant.

2. The method of claim 1 in which the temperature of the pipe in the heating zone is maintained a constant by adjustment of the power applied to the heating/cooling unit.

3. The method of claim 1 in which the temperature of the pipe in the heating zone is maintained a constant by adjustment of the power applied to the heating/cooling unit by adjustment of the relative motion between the pipe and the heating/cooling unit.

4. The method of claim 3 wherein the relative movement is controlled in the initial and terminal portions of the bend by movement of both the pipe and the heating-/cooling/unit, and controlled in the intermediate portion of the bend by movement of the pipe while maintaining the heating/cooling unit stationary.

5. An apparatus for hot bending a metal pipe in which the pipe is passed through a heating zone in a heating-/cooling unit while a bending movement is applied and thereafter through a cooling zone in the heating/cooling unit adjacent to the heating zone, and in which the radius of curvature of the bend is larger than the desired radius in the initial and terminal (relatively smaller angle) portions of the bend and smaller than the desired radius in the relatively larger angle intermediate portion of the bend, the improvement in which the temperature of the pipe while in the heating zone is maintained a constant, the improvement comprising means for maintaining the temperature of the pipe while in the heating zone a constant.

6. An apparatus of claim 5 wherein said temperature maintenance means comprises means for varying the power applied to said heating/cooling unit.

7. An apparatus of claim 5 wherein said temperature maintained means comprises means for varying the relative movement of the pipe with respect to said heating/cooling unit.

8. An apparatus of claim 7 wherein said relative movement varying means includes means for independently moving the pipe and said heating/cooling unit.

* * * * *

UNITED STATES PATENT AND TRADEMARK OFFICE

CERTIFICATE OF CORRECTION

PATENT NO. : 4,412,442

DATED : November 1, 1983

INVENTOR(S) : Shunpei Kawanami, Hiratsuka; Yasuo Watanabe, Kitakyushu; Susumu Hanyo, Yokusuka It is certified that error appears in the above—identified patent and that said Letters Patent is hereby corrected as shown below:

Claim 1, line 9, change "greater" to --smaller--.

Signed and Sealed this

*Seventeenth* Day of *April 1984*

[SEAL]

*Attest:*

GERALD J. MOSSINGHOFF

*Attesting Officer*

*Commissioner of Patents and Trademarks*